US005818406A

United States Patent [19]

Tsuchi et al.

[11] Patent Number: 5,818,406

[45] Date of Patent: Oct. 6, 1998

[54] DRIVER CIRCUIT FOR LIQUID CRYSTAL DISPLAY DEVICE

[75] Inventors: Hiroshi Tsuchi; Hiroshi Hayama, both of Tokyo, Japan

[73] Assignee: NEC Corporation, Tokyo, Japan

[21] Appl. No.: 564,570

[22] Filed: Nov. 28, 1995

[30] Foreign Application Priority Data

Dec. 2, 1994 [JP] Japan ..... 6-299872

[51] Int. Cl.[6] ..... G09G 3/36

[52] U.S. Cl. ..... 345/89; 345/87; 345/211; 345/52

[58] Field of Search ..... 345/89, 87, 76, 345/92, 90, 100, 94, 208, 49, 211, 212, 52; 359/59; 257/347, 349, 351, 352; 327/108

[56] References Cited

U.S. PATENT DOCUMENTS

| | | | |
|---|---|---|---|
| 4,302,751 | 11/1981 | Nakauchi et al. | 345/49 |
| 4,736,137 | 4/1988 | Ohwada et al. | 345/76 |
| 5,196,738 | 3/1993 | Takahara et al. | 345/89 |
| 5,412,240 | 5/1995 | Inoue et al. | 257/347 |
| 5,530,266 | 6/1996 | Yonehara et al. | 359/59 |
| 5,534,885 | 7/1996 | Saitoh | 345/89 |
| 5,561,440 | 10/1996 | Kitajima et al. | 345/87 |
| 5,617,111 | 4/1997 | Saitoh | 345/208 |

FOREIGN PATENT DOCUMENTS

| | | |
|---|---|---|
| 7-153914 | 10/1981 | Japan . |
| 3-264922 | 11/1991 | Japan . |
| 3-274089 | 12/1991 | Japan . |
| 3-274090 | 12/1991 | Japan . |
| 4-204689 | 7/1992 | Japan . |

*Primary Examiner*—Steven J. Saras
*Assistant Examiner*—John Suraci
*Attorney, Agent, or Firm*—Whitman, Curtis & Whitman

[57] ABSTRACT

A driver circuit for a liquid crystal display device has an output terminal, an N-MOS transistor, a P-MOS transistor, a first semiconductor switch connected between the output terminal and the N-MOS transistor and, a second semiconductor switch connected between the output terminal and the P-MOS transistor. Each of the N-MOS transistor and the P-MOS transistor have source, drain, gate and substrate, and form a power source portion taking the source as an output side. The first and second semiconductor switches have control inputting means for inputting a switching control signal for alternately outputting the output voltages of the N-MOS transistor and the P-MOS transistor through the output terminal. The drain, gate and substrate voltages are set so that the output voltage output from the N-MOS transistor is greater than the output voltage output from said P-MOS transistor.

4 Claims, 14 Drawing Sheets

DRIVER CIRCUIT FOR LIQUID CRYSTAL DISPLAY DEVICE

BACKGROUND OF THE INVENTION

1. Field of the Invention

The present invention relates to a driver circuit for a liquid crystal display device employing a driver circuit for a digital signal input and digital signal output data line.

2. Description of the Related Art

In the recent years, associating development of multimedia information system, an active matrix type liquid crystal display device employing a thin film field effect transistor (TFT-LCD) have been widely used. As a driver LSI for such liquid crystal display device, a demand for employing a digital RGB signal input and a digital signal voltage output type data line driver circuit which does not require a digital-to-analog conversion and so forth is progressively getting higher.

However, in order to express gray-scale by the digital RGB signal input and the digital signal voltage output, an LSI having small area by monolithic integration including a power source circuit, becomes necessary. Furthermore, precise output of the power source voltage and operation speed depending upon each gray level, are also required. Furthermore, by continuously applying direct current voltage to the liquid crystal elements, fatigue may be caused in display. Accordingly, it becomes necessary to provide alternate current driving, in which opposite polarity of voltages are alternately applied to the liquid crystal elements.

Therefore, a driver for multi-tone (gray-scale) display and a liquid display device employing the former, which is effective for a color liquid crystal display having a TFT active matrix construction for multi-color display in digital system and has reduced number of circuit elements, have been disclosed in Japanese Unexamined Patent Publication (Kokai) No. Heisei 4-204689, for example. The disclosed system employs a C-MOS switch as a switch corresponding to the closest voltage to a selected level selected by a voltage selector. Also, the driver for multi-tone display employs N-channel MOSFETs or P-channel MOSFETs having gate and source voltages higher than or equal to a threshold value, as switching MOSFETs corresponding to respective voltage for various tones of display.

On the other hand, in Japanese Unexamined Patent Publication No. Heisei 3-264922, an accurate visual angle correction type and multi-tone liquid crystal display device, which is effective for similar color liquid crystal display and facilitating adjusting of gray-level with respect to variation of the visual angle in the vertical direction, for example. In the disclosed system, two mutually different visual angles in the vertical direction are taken with respect to the liquid crystal panel. With respect to these, an approximated reference voltage is derived from an intersecting point of a graph of luminance-voltage characteristics corresponding to the above-mentioned two visual angles. Then, a voltage varying corresponding to these visual angles is established for correcting the drive voltage for the gray-scale by a divided voltage associating with the voltage varying corresponding to these visual angles.

However, these circuits encounter a problem, in that a plurality of external power sources are required or the output impedance will not be uniform, or so forth.

Also, Japanese Unexamined Patent Publication No. Heisei 3-274089 discloses a liquid crystal display device which can easily optimally adjust the correction voltage without employing a special jig. The disclosure is directed to the liquid crystal display device, in which a liquid crystal panel is driven with a plurality of voltages. The disclosed liquid crystal display device includes a circuit for generating a voltage substantially at the center between the highest voltage and the lowest voltage. Also, the liquid crystal display device includes a circuit for generating at least one voltage lower than or higher than the center voltage by inverting amplification of at least one voltage among voltages higher than or lower than the center voltage with taking the center voltage as reference.

In addition, Japanese Unexamined Patent Publication No. Heisei 3-274090 discloses a liquid crystal display device driving a liquid crystal panel with a plurality of voltages, which solves a similar problem in Japanese Unexamined Patent Publication No. Heisei 3-274089 set forth above. The disclosed system includes a circuit, in which a difference two voltages among a plurality of voltages is converted into a current, and the current is converted into a voltage with reference to one of a plurality of voltages to generate one of a plurality of voltages.

These technologies require a large number of operational amplifiers in relation to a voltage value to be output. Therefore, large power consumption and large occupied area become necessary to make monolithic integration difficult.

SUMMARY OF THE INVENTION

It is an object of the present invention to provide a driver circuit for a liquid crystal display device employing a data line driver circuit for a digital signal input and a digital signal output, which can accurately output a power source voltage with a simple circuit construction.

A driver circuit for a liquid crystal display devices according to the present invention, comprises:

an output terminal;

an N-MOS transistor;

a P-MOS transistor, each of said N-MOS transistor and said P-MOS transistor having source, drain, gate and a substrate, and constituting a power source portion taking the source as an output side, and voltages of said drains, said gates and said substrates of said N-MOS transistor and said P-MOS transistor being set so that the output voltage $E_{N1}$ output from said N-MOS transistor is greater than the output voltage $E_{P1}$ output from said P-MOS transistor;

a first semiconductor switch connected between said terminal and said N-MOS transistor; and a second semiconductor switch connected between said output terminal and said P-MOS transistor, said first and second semiconductor switches having control inputting means for inputting a switching control signal for alternately outputting the output voltages of said N-MOS transistor and said P-MOS transistor through said output terminal.

In the driver circuit for a liquid crystal display device set forth above, the first and second semiconductor switches may be constructed by a transfer gate, an N-MOS pass transistor or a P-MOS pass transistor.

In the driver circuit for a liquid crystal display device as set forth above, one of said first and second semiconductor switches may be constructed by an N-MOS pass transistor and the other may be constructed by a P-MOS pass transistor.

A driver circuit for a liquid crystal display device, according to another construction of the present invention, comprises:

an output terminal;

n in number of N-MOS transistors;

m in number of P-MOS transistors, each of said N-MOS transistors and said P-MOS transistors having source, drain, gate and a substrate, and constituting a power source portion taking the source as an output side, and voltages of said drains, said gates and said substrates of said N-MOS transistors and said P-MOS transistors being set so that the output voltages EN output from said all N-MOS transistors are greater than the output voltages $E_P$ output from said all P-MOS transistors; and n in number of first semiconductor switches, each of said switches being connected between said output terminal and said N-MOS transistor;

m in number of second semiconductor switches, each of said switches being connected between said output terminal and said P-MOS transistor, said first and second semiconductor switches having control inputting means for inputting a switching control signal for alternately outputting the output voltages of said N-MOS transistor and said P-MOS transistor through said output terminal.

In the driver circuit for a liquid crystal display device as set forth above, said first semiconductor switches and said second semiconductor switches may be constituted by transfer gates, N-MOS transistors or P-MOS transistors.

In the driver circuit for a liquid crystal display device, among said first semiconductor switches and said second semiconductor switches, X in number ($0 \leqq X \leqq (n+m)$) of semiconductor switches may be constructed by N-MOS pass transistors, and remaining semiconductor switches may be constructed by P-MOS pass transistors.

The driver circuit for the liquid crystal display device according to the present invention controls the power source voltages from the N-MOS transistors and the P-MOS transistors by the semiconductor switch, thus accurate power source voltage can be output with simple circuit. Accordingly, the driver circuit of the liquid crystal display device employing the digital signal input and the digital signal output data line driver circuit can be easily fabricated.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The preferred embodiments of the present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to not unnecessarily obscure the present invention.

Figure 1:
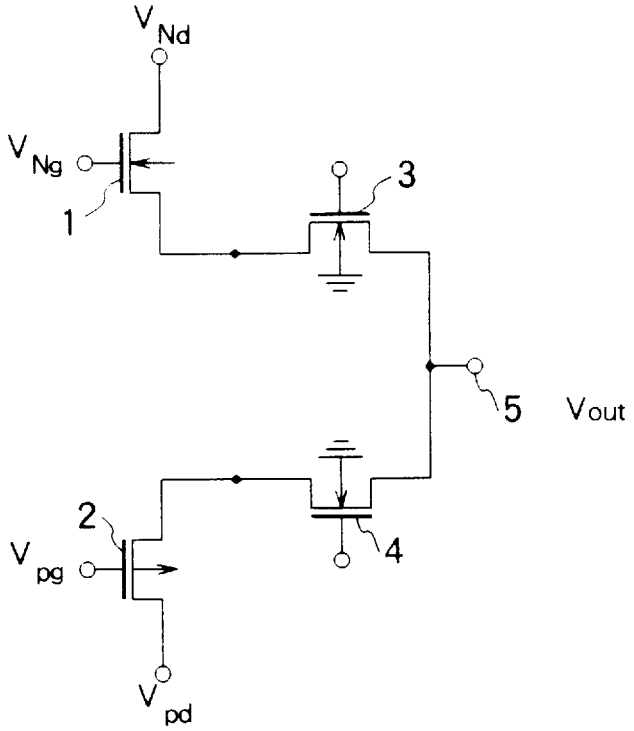
FIG. 1 is a circuit diagram showing a part of a driver circuit for a liquid crystal display device according to a first embodiment of the present invention.

FIG. 1 is a circuit diagram showing a part of a driver circuit for a liquid crystal display device according to a first embodiment of the present invention. An N-MOS transistor 1 and a P-MOS transistor 2 are power source portions taking respective sources as an output side. Between the N-MOS transistor 1 and an output terminal 5, a first semiconductor switch 3 is provided. Similarly, between the P-MOS transistor 2 and the output terminal 5, a second semiconductor switch 4 is provided. In the shown embodiment, as the semiconductor switches 3 and 4, N-MOS pass transistors are employed.

In the circuit constructed as set forth above, by controlling the semiconductor switches 3 and 4, the power source voltages from the N-MOS transistor 1 and the P-MOS transistor 2 are alternately selected, and an output voltage $V_{OUT}$ is output from an output terminal 5.

Figure 2:
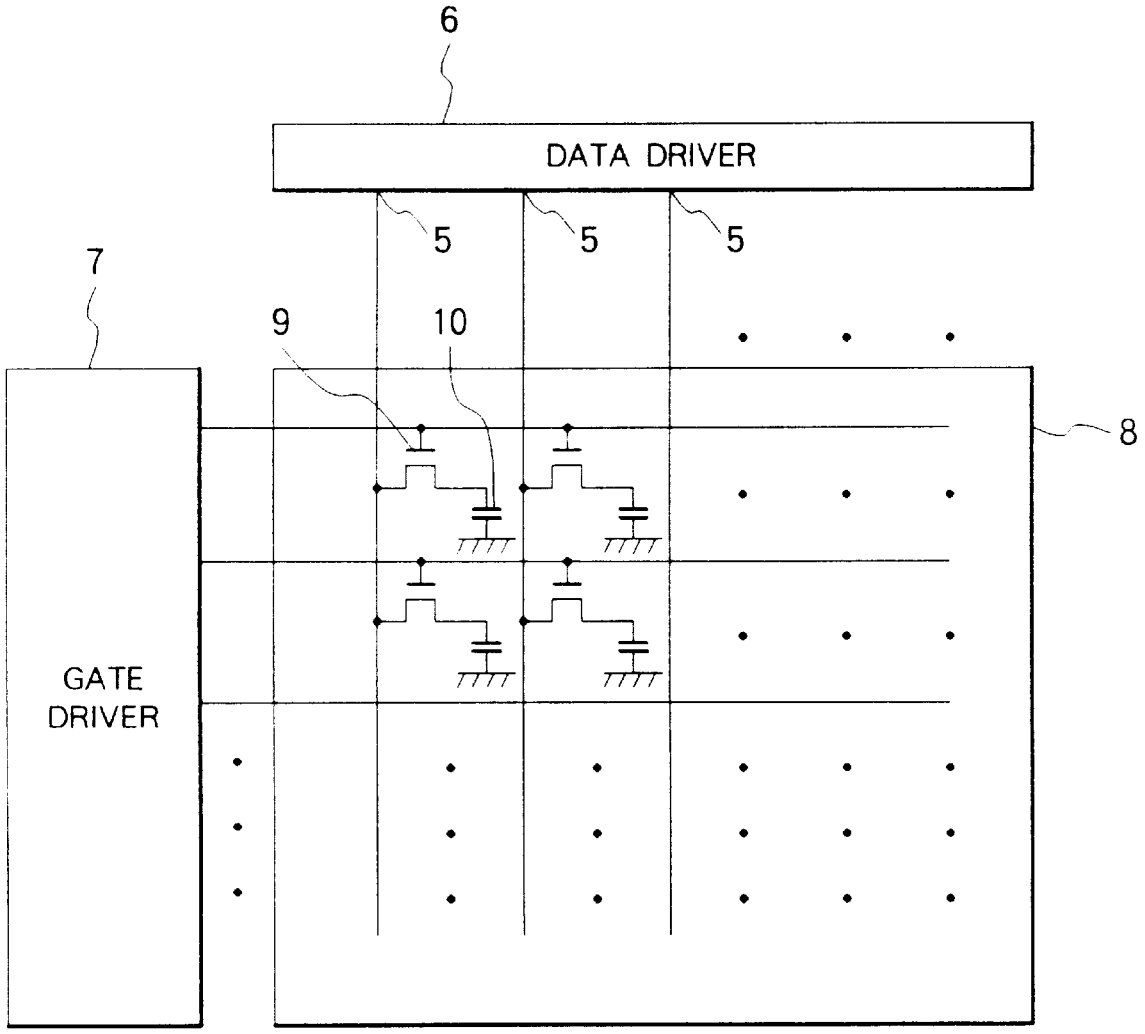
FIG. 2 is a block diagram showing a construction of the liquid crystal display device, to which the circuit of FIG. 1 is applied.

FIG. 2 is a block diagram showing a construction of the liquid crystal display device, to which the circuit of FIG. 1 is applied. The circuit of FIG. 1 incorporates a data driver 6. The output voltage VOUT of the circuit of FIG. 1 is output from the data driver 6. A TFT panel 8 is constructed with a plurality of pixels arranged in a matrix. A pixel capacitor 10 is formed with a pixel electrode and a grounded common electrode. Between each pixel capacity 10 and an output line of the data driver 6, TFT 9 is connected. The gate of TFT 9 is connected to an output line of a gate driver 7.

In the liquid crystal display device constructed as set forth above, pulse voltages are sequentially applied to the gates of the TFTs 9 by the gate driver 7, and output voltage $V_{OUT}$ is output from the data driver 6. Thus, a pixel connected to TFT 9 placed in the conductive state controlled by the gate driver 7, is illuminated by application of the output voltage of the data driver 6. Thus, the display elements arranged in a matrix are driven to display an image on a liquid crystal display screen.

In the shown embodiment of the driver circuit, by setting a drain voltage $V_{Nd}$, a gate voltage $V_{Ng}$ and a substrate voltage in the N-MOS transistor 1, a threshold voltage $V_{Nt}$ can be obtained. By the voltage drop utilizing the threshold voltage $V_{Nt}$, a voltage $E_{N1}$ ($E_{N1}=V_{Ng}-V_{Nt}$) can be output through a source terminal. On the other hand, by setting a drain voltage $V_{Pd}$, a gate voltage $V_{pg}$ and a substrate voltage in the P-MOS transistor 2, a threshold voltage $V_{Pt}$ is obtained. Then, by a voltage drop utilizing the threshold voltage $V_{Pt}$, a voltage $E_{P1}$ ($E_{P1}=V_{Pg}-V_{Pt}$) can be output through a source terminal.

Figure 3:
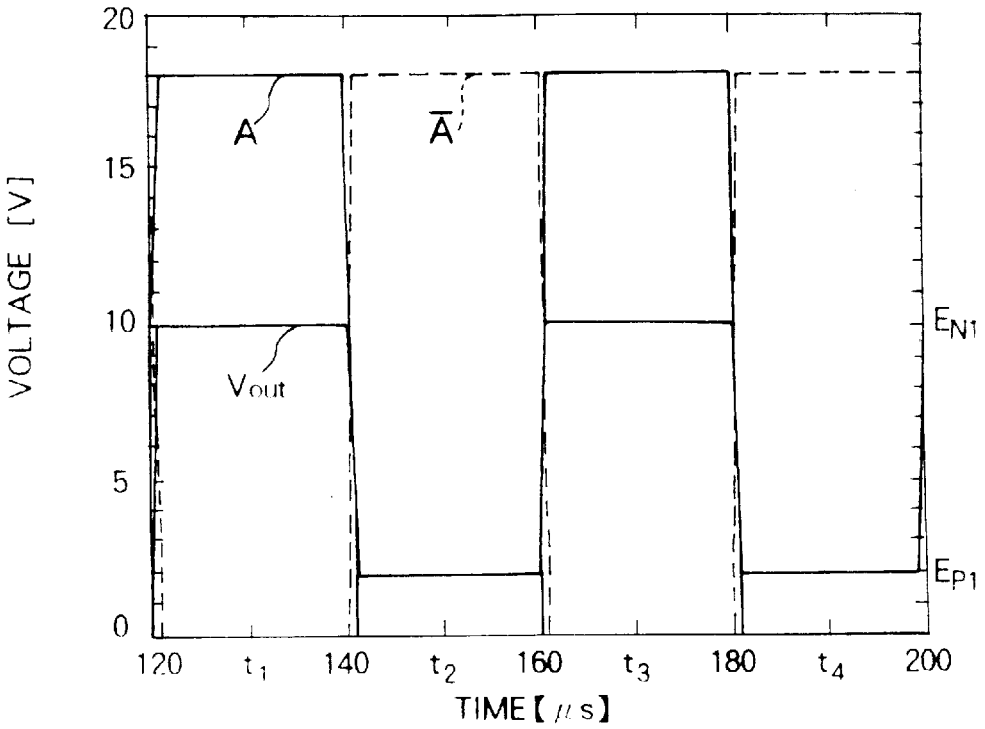
FIG. 3 is a graph showing variation of a switching control signal of the driver circuit of FIG. 1 and the corresponding output voltage $V_{out}$ based on a voltage in the vertical axis and a time in the horizontal axis.

FIG. 3 is a graph showing variation of a switching control signal of the driver circuit of FIG. 1 and the corresponding output voltage $V_{out}$ based on a voltage in the vertical axis and a time in the horizontal axis. At respective gate terminals of the semiconductor switches 3 and 4 employing the N-MOS pass transistors, a signal A shown in FIG. 3 as a switching control signal and a reverse signal $\overline{A}$ are input. At this time, output voltages $E_{N1}$ and $E_{P1}$ are alternately output through the output terminal while the output voltage $E_{N1}$ of the transistor 1 as the power source is higher than the output voltage $E_{P1}$ of the transistor 2. Namely, it is assumed that the power source voltage of the N-MOS transistor 1 is 10V and the power source voltage of the P-MOS transistor 2 is 2V, and is further assumed that the signal A is input to the semiconductor switch during a first output period $t_1$. Then, the N-MOS transistor 1 is selected. Thus, the output voltage $E_{N1}$, i.e. 10V, is output from the output terminal 5. Also, in the next second output period $t_2$, the reverse signal $\overline{A}$ is input to the semiconductor switch 4. Thus, the P-MOS transistor 2 is selected. Accordingly, the voltage to be output through the output terminal 5 can be dropped to the voltage $E_{P1}$, i.e. 2V. Then, in the further next third output period $t_3$, the voltage to be output through the output terminal 5 is again risen to 10V ($E_{N1}$) by the semiconductor switch 3.

Thus, the voltage $E_{P1}$ and $E_{N1}$ can be output accurately through the output terminal 5. Accordingly, the driver circuit for a digital signal input and digital signal output data line can drive the liquid crystal display device accurately.

However, in the driver circuit constructed as set forth above, if the output voltage $E_{N1}$ of N-MOS transistor 1 is lower than or equal to the output voltage $E_{P1}$ of P-MOS transistor 2, the voltage $E_{N1}$ and $E_{P1}$ can not be output accurately through the output terminal 5.

Figure 4:
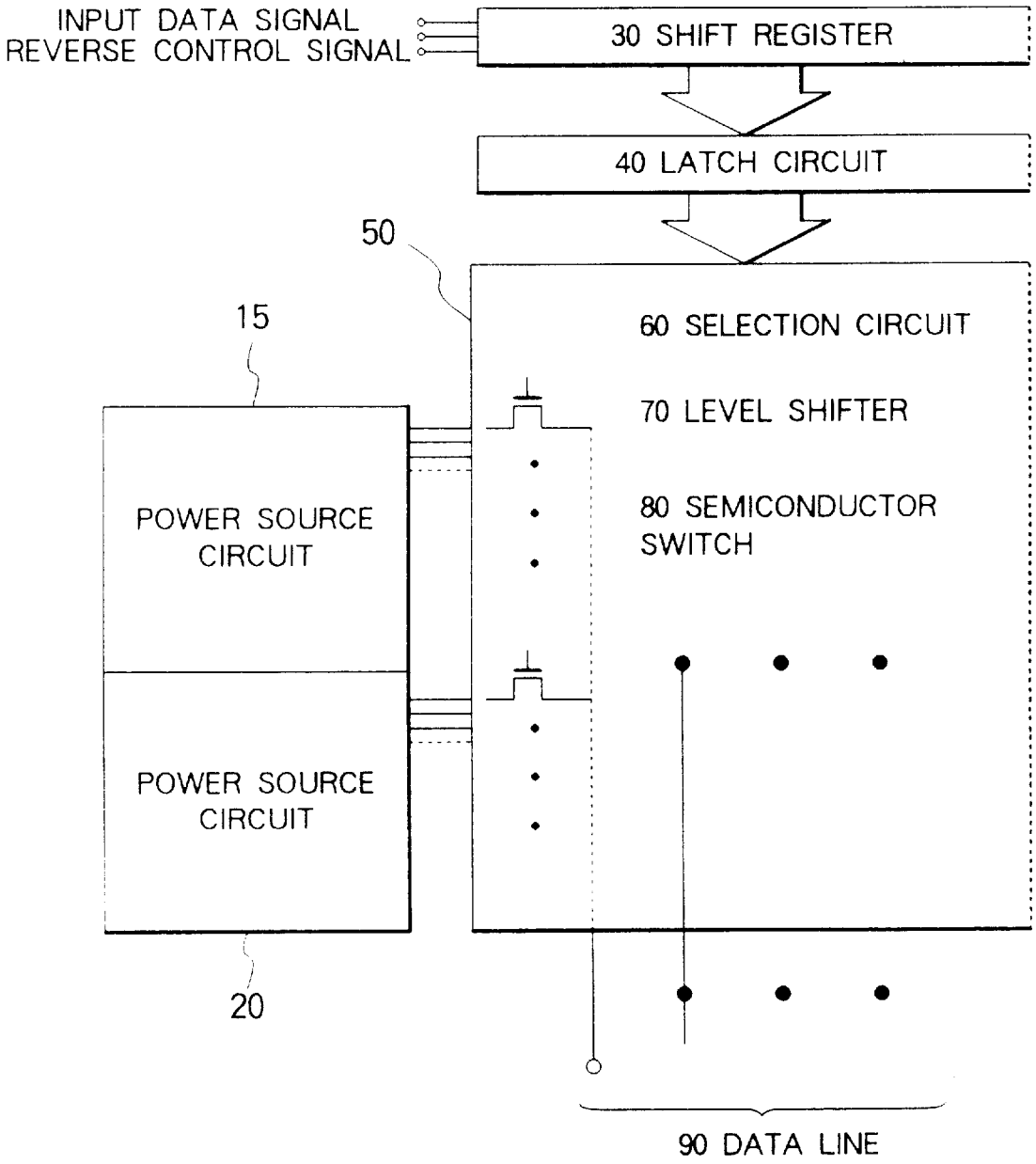
FIG. 4 is a block diagram showing a construction of the second embodiment of a driver circuit according to the present invention.

FIG. 4 is a block diagram showing a construction of the second embodiment of the driver circuit according to the present invention. A power source circuit 15 is constructed with n N-MOS transistors and a power source circuit 20 is constructed with m P-MOS transistors. The power source circuits 15 and 20 respectively form power source portions taking sources as output sides. Accordingly, the power source circuit 15 has n output terminals and the power source circuit 20 has m output terminals. Here, n and m are natural numbers greater than or equal to 1.

In the driver circuit constructed as set forth above, at first, a several bit data signal and one bit reverse control signal are input to a shift register 30. This signal is fed to a function block 50 via a latch circuit 40, a buffer amplifier (not shown) and so forth. The function block 50 is constructed with a selection circuit 60, a level shifter 70, a semiconductor switch 80 and so forth. Then, by input reverse control signal, the power source circuits 15 and 20 are alternately selected. In conjunction therewith, the output voltages of the power source circuits 15 and 20 are selected by the data signal. The voltage is output through a data line 90.

In the second embodiment shown in FIG. 4, in an output period comprises a series of first and second output periods, voltages of drains, gates and the substrates of the N-MOS transistor and the P-MOS transistor are set. Namely, all of the output voltage $E_N$ output from the source terminal of the N-MOS transistor included in the power source circuit 15 is set to be greater than the output voltage $E_P$ output from the source terminal of the P-MOS transistor included in the power source circuit 20. Accordingly, a voltage is accurately output through the data line 90.

In the shown embodiment, for example, when a common electrode of the liquid crystal display device is set to a potential $V_c$, all of the output voltages output from the n output terminals of the power source circuit 15 of FIG. 4 are set to be higher than $V_c$. On the other hand, all of the output voltages output from the output terminals (m in number) of the power source circuit 20 shown in FIG. 4 are set to be lower than $V_c$. At this time, mutually opposite polarity of voltages with respect to the potential $V_c$ are output to the data line 90, and an accurate output voltage can be obtained. Also, fatigue of liquid crystal element can be prevented.

On the other hand, a multi-value voltage source circuit has been disclosed in commonly owned Japanese Unexamined Patent Publication No. Heisei 7-153914, as a power source circuit. The disclosed multi-value voltage source circuit has a resistor element group divided by n resistor elements connected to the voltage between a first terminal and a second terminal in series, and MOS transistor group constituted of (n+1) in number of MOS transistors having commonly connected drain terminals. (n+1) respective gate terminals in the MOS transistor group, and first and second terminals and (n−1) dividing points of the resistor element group are connected in one by one basis. Furthermore, for the common drain terminals of the MOS transistor group and the first and second terminals, voltages are externally applied, respectively to take out the output voltage to the output terminal through respective source terminals of the MOS transistor group. By this, it becomes possible to output a large number of mutually different voltages from a smaller number of voltage sources. Also, with the construction set forth above, it becomes possible to from a circuit construction which has a constant output impedance and thus does not require an operational amplifier. Therefore, monolithic integration of the circuit can be easily realized.

When such multi-value power source circuit is constructed with N-channel MOS transistors, for example, and when the voltage at the output terminal is lower than the desired voltage, the voltage can be output at the voltage elevated to the desired voltage. However, when the voltage at the output terminal is higher than the desired voltage, it is not possible to lower the voltage to the desired voltage for outputting.

On the other hand, when the multi-value power source circuit is constructed with P-channel MOS transistors, and when the voltage at the output terminal is higher than the desired voltage, it is possible to output the voltage lowered to the desired voltage. However, when the voltage at the output terminal is lower than the desired voltage, it is not possible to output the voltage elevated to the desired voltage.

Accordingly, when such multi-value circuit is employed, it is possible that the desired voltage cannot be output accurately.

Figure 5:
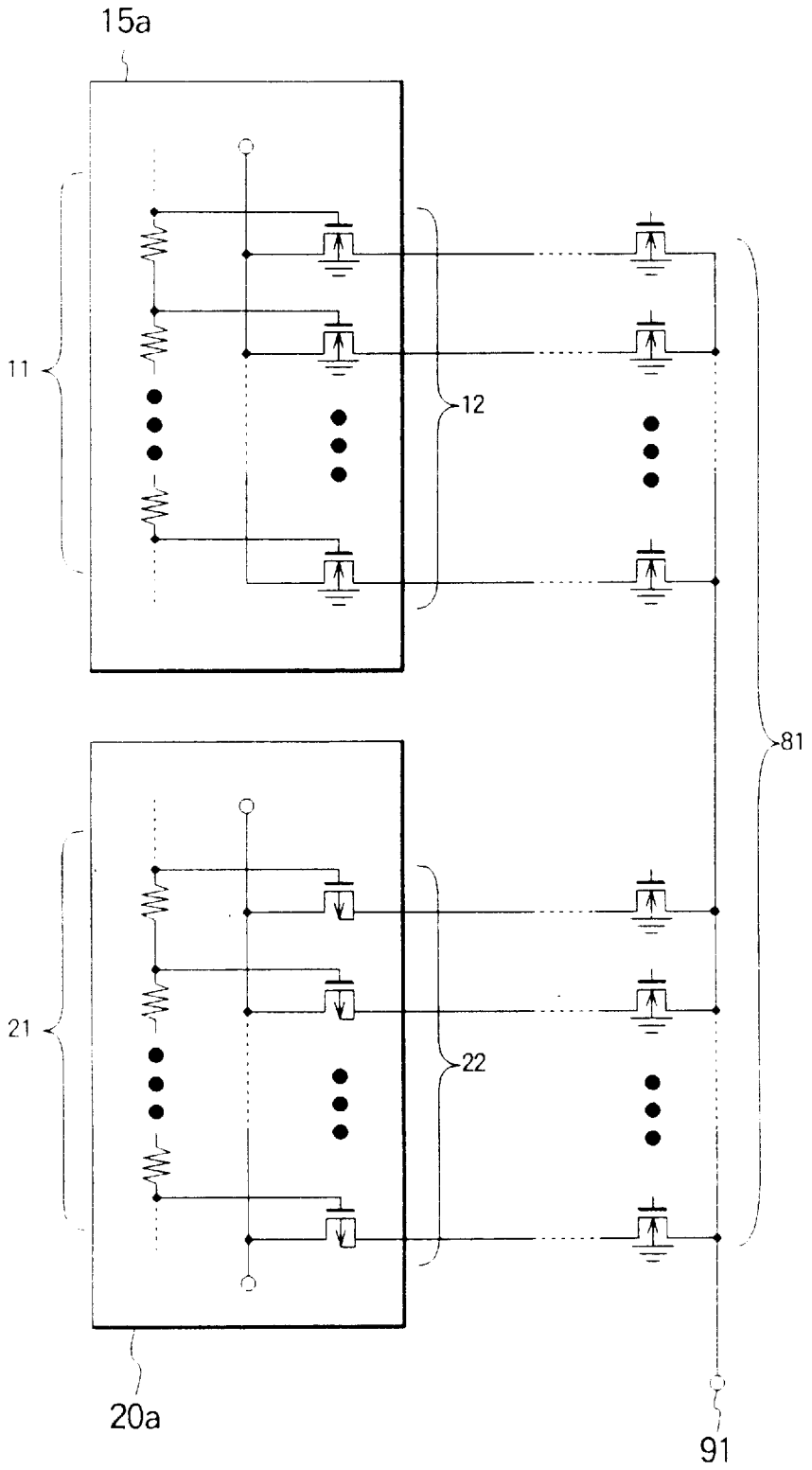
FIG. 5 is a circuit diagram showing a basic construction of the third embodiment of the driver circuit according to the present invention.

FIG. 5 is a circuit diagram showing a basic construction of a driver circuit of the third embodiment according to the present invention. In the shown embodiment, the multi-value voltage source circuit (as disclosed in Japanese Unexamined Patent Publication No. Heisei 7-153914) is applied. One Example of the circuit construction of the semiconductor switches of the power source circuits 15 and 20 is shown in FIG. 5.

A power source circuit 15*a* is constructed with resistor element group 11 and the N-MOS transistor group 12, as multi-value voltage source circuit. On the other hand, a power source circuit 20*a* is constructed with resistor element group 21 and the P-MOS transistor group 22. The output lines of the power source circuits 15*a* and 20*a* are connected to data lines 91 via semiconductor switch group 81. In the shown embodiment, N-MOS pass transistor is employed as the semiconductor switch.

In the driver circuit constructed as set forth above, the voltages set by a resistance ratio of the resistor element groups 11 and 21 are input to respective gate terminals of MOS transistor group 12 and 22. Then, the voltages lowered by threshold voltages from the gate voltages are output through the source terminals. The multi-value voltage source circuit is of a low power consumption type which does not require the operational amplifier, and a plurality of output voltages can be obtained from smaller number of external power sources. On the other hand, in the shown embodiment, semiconductor switch group 81 is connected between the N-MOS transistor group 12 and the P-MOS transistor group 22, and the data line output terminals. Accurate output voltage can be output from the data line 91 with the simple circuit construction.

Figure 6A:
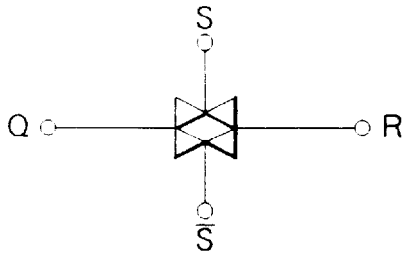
FIG. 6A to 6D are circuit diagrams showing examples of semiconductor switches which can be employed in the present invention.
Figure 6B:
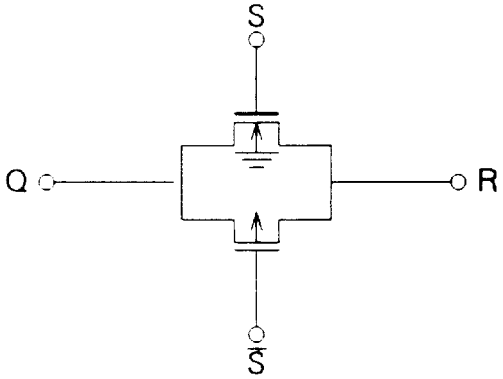
Figure 6C:
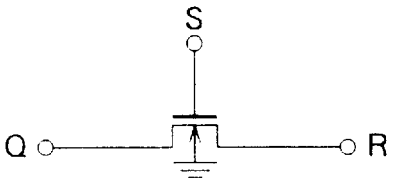
Figure 6D:
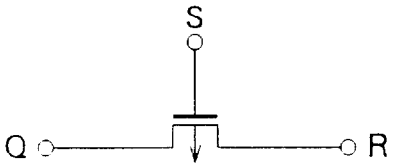

FIGS. 6A to 6D are circuit diagrams showing examples of semiconductor switches which can be employed in the present invention. FIGS. 6A and 6B are semiconductor switches employing transfer gates, FIG. 6C is a semiconductor switch employing N-MOS pass transistor, and FIG. 6D is a semiconductor switch employing P-MOS pass transistor. In any of these switches, terminals Q are connected to power source output terminals, and terminals R are connected to data lines. Accordingly, when the switching control signal is input through a terminal S or $\overline{S}$ in conjunction with inputting of the voltage to the terminal Q from the power source circuit, the power source circuits can be selected alternately.

The semiconductor switch may be a switching element or a switching circuit. Also, it is possible to use different kinds of semiconductor switches together.

The driver circuits of FIGS. 4 and 5 may be constructed with two voltage systems, i.e. a high voltage system (e.g. 18V system) and a low voltage system (e.g. 5V system).

Figure 7:
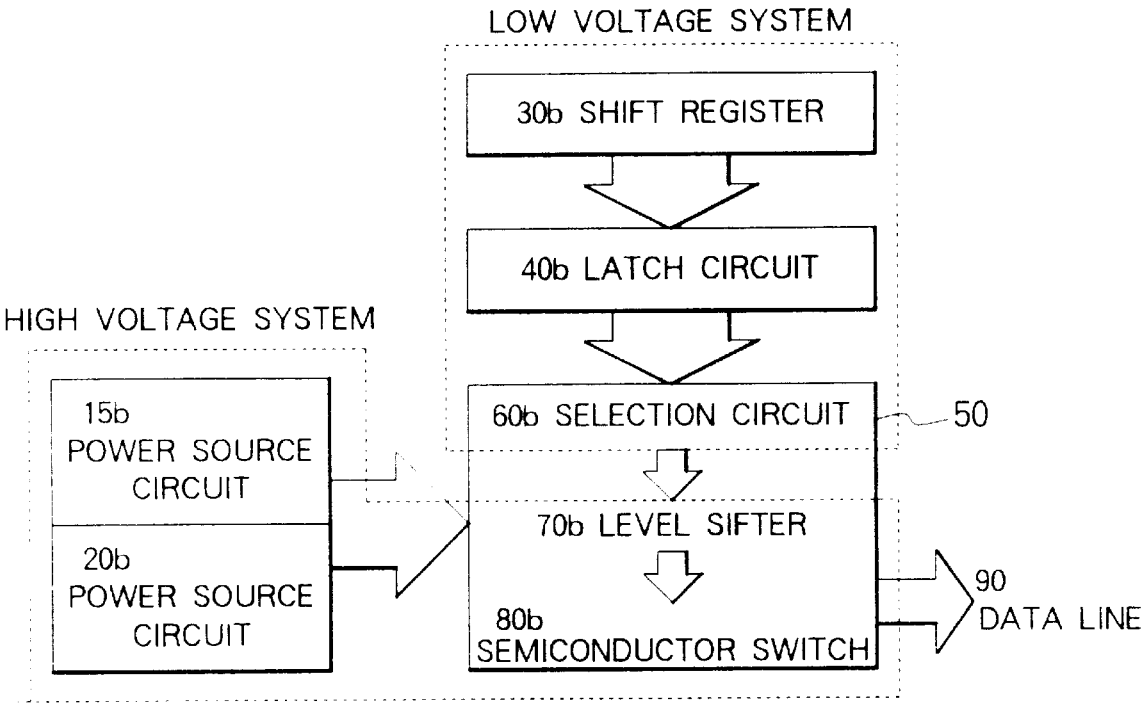
FIG. 7 is a block diagram showing a driver circuit when a selection circuit 60 shown in the block diagram of FIG. 4 is constructed with a low voltage system.

FIG. 7 is a block diagram showing the driver circuit when the selection circuit 60 in the block diagram of FIG. 4 is constructed with a low voltage system. In the shown embodiment, power source circuit 15*b* and 20*b*, level shifter 70*b* and semiconductor switch 80*b* are constructed in a high voltage system and a shift register 30*b*, a latch circuit 40*b* and a selection circuit 60*b* are constructed in a low voltage system.

FIGS. 8 to 11 are circuit diagrams showing low voltage system selection circuits 60*b* to be employed in the driver circuit of FIG. 7.

In the circuit shown in FIGS. 8 to 11, output signals D1 and D2 from the latch circuit 40*b* and their inverted signals $\overline{D1}$ and $\overline{D2}$ are input to the selection circuit 60*b* to make the selection circuit to output signals C1 to C4. In FIGS. 8 to 11, a circuit construction in the case of two bit input signal is shown. However, even when the number of its is increased, the similar construction may be employed. In such case, if the bit number is b, the number of outputs corresponds to $2^b$. Also, the inverted control signal can be handled similarly to the data signal, and can be input to any input terminals of the selection circuit 60*b*.

Figure 12:
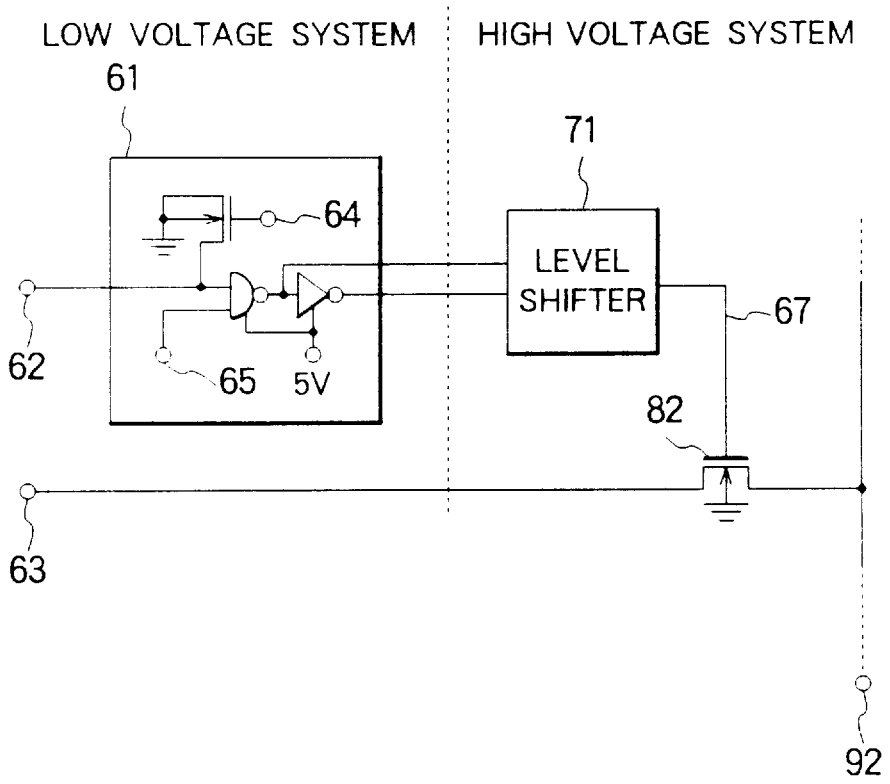
FIG. 12 is a circuit showing an internal construction of a functional block 50 in the driver circuit of FIG. 7.

FIG. 12 is a circuit diagram showing an internal construction of the functional block 50 in the driver circuit of FIG. 7.

In the circuit shown in FIG. 12, the output signal from the selection circuit is input to an input terminal 62. Then, the output signal and its inverted signal are output from the circuit block 61. These signals are converted from low voltage system (5V) to high voltage system (18V) by the level shifter 71, and taken out through a line 67. Then, the signal is input to the semiconductor switching element 82 as the switching control signal, and output voltage of the power source circuit which is input to the input terminal 63 is output through a data line 92.

Figure 8:
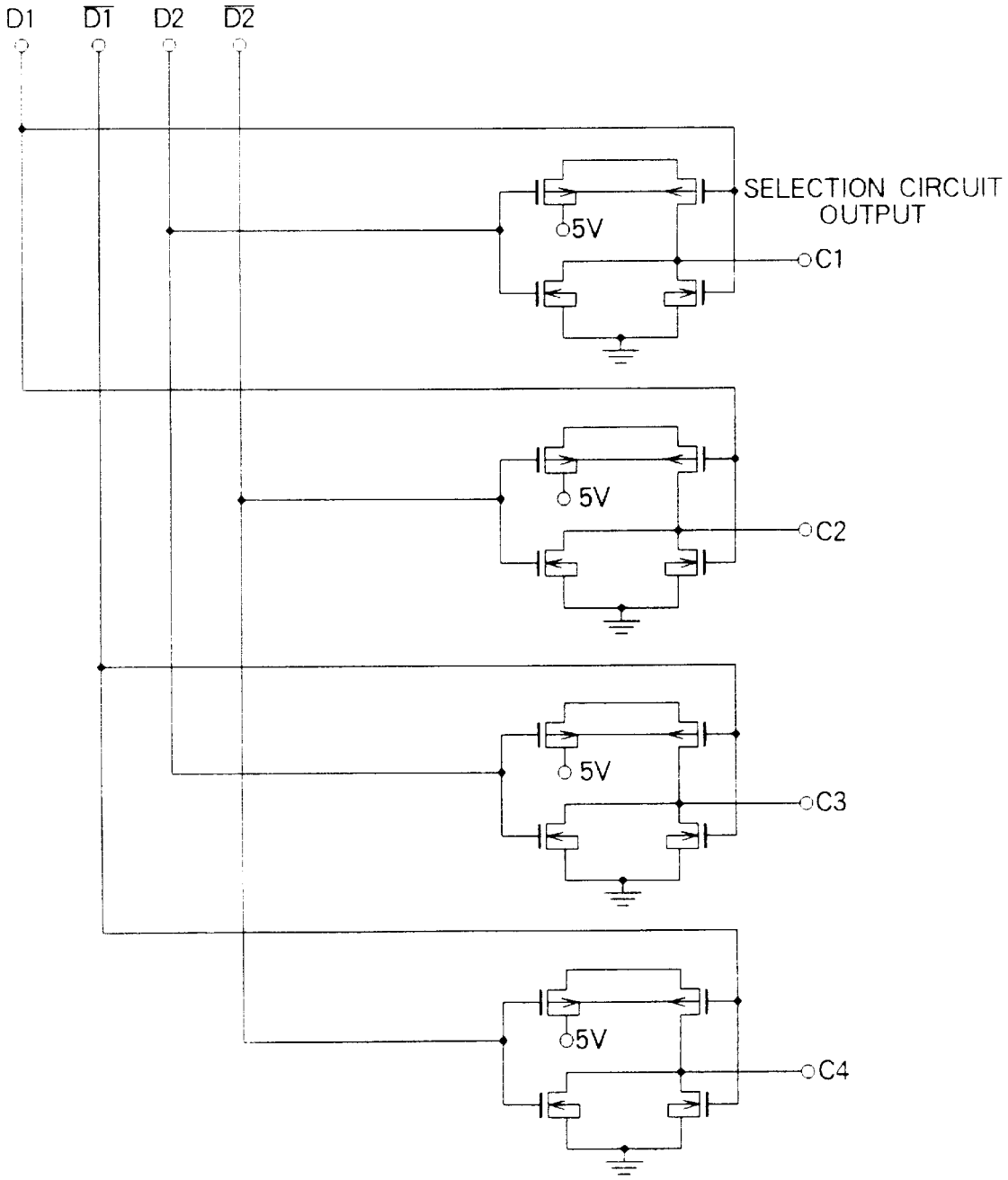
FIG. 8 is a circuit diagram showing a low voltage system selection circuit which can be employed in the driver circuit of FIG. 7.
Figure 9:
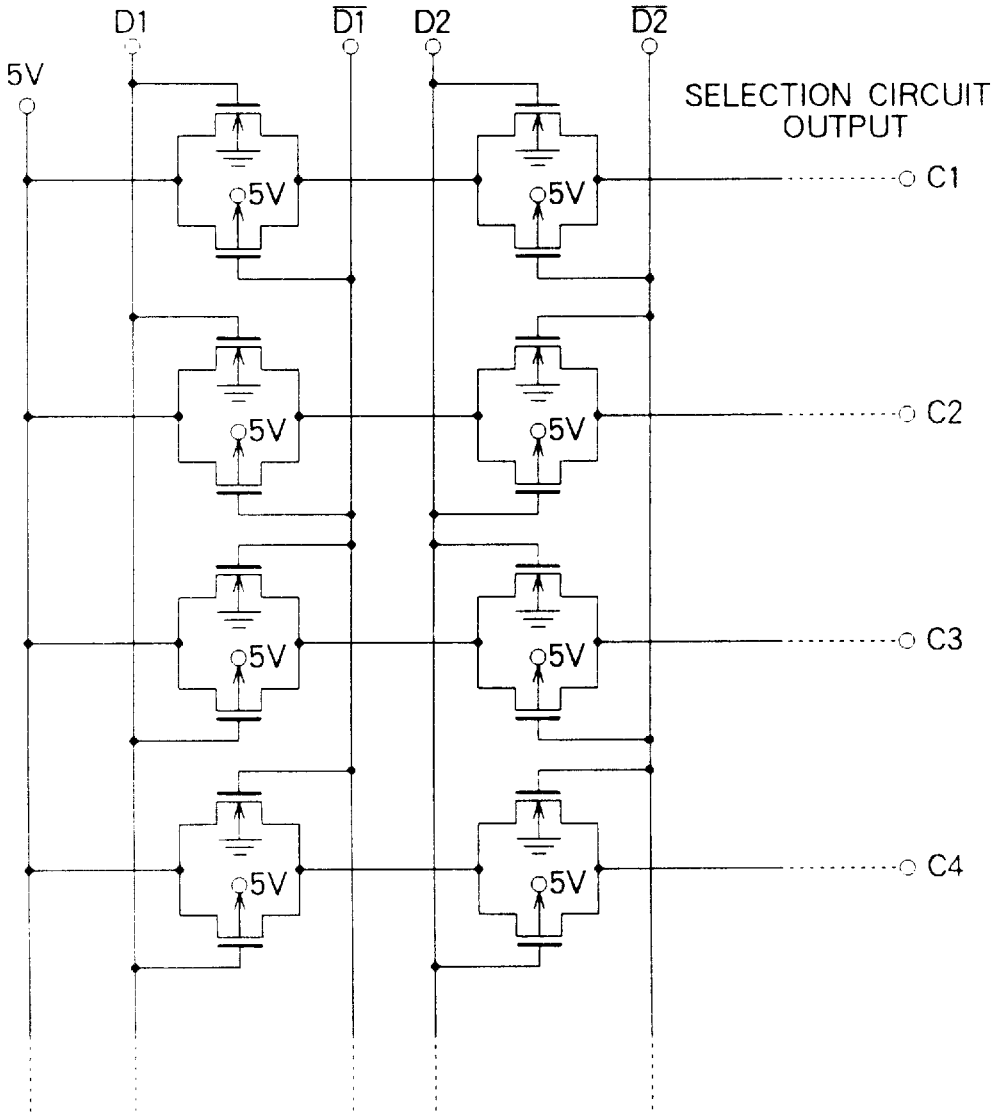
FIG. 9 is a circuit diagram showing a low voltage system selection circuit which can be employed in the driver circuit of FIG. 7.
Figure 10:
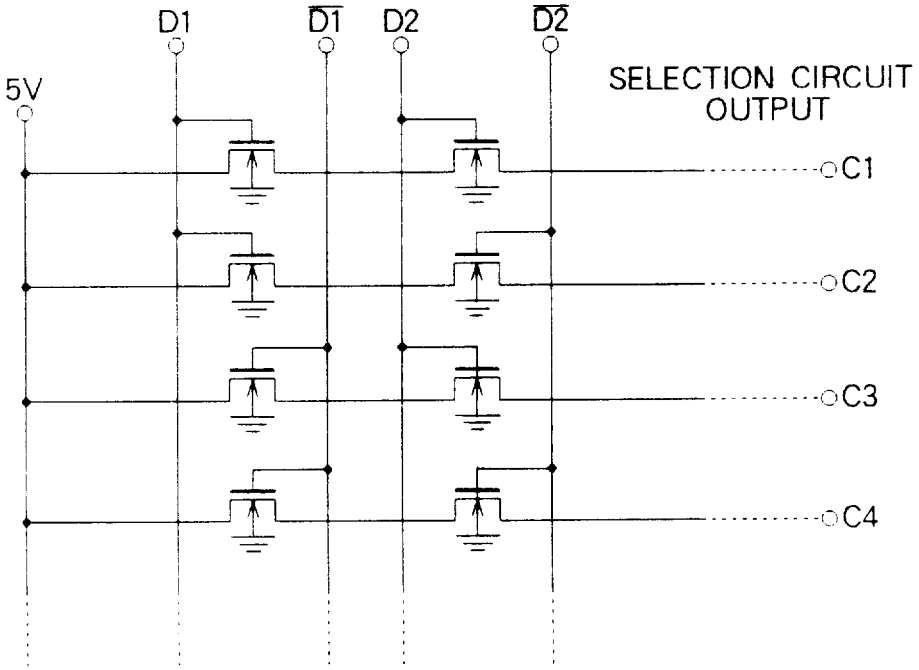
FIG. 10 is a circuit diagram showing a low voltage system selection circuit which can be employed in the driver circuit of FIG. 7.
Figure 11:
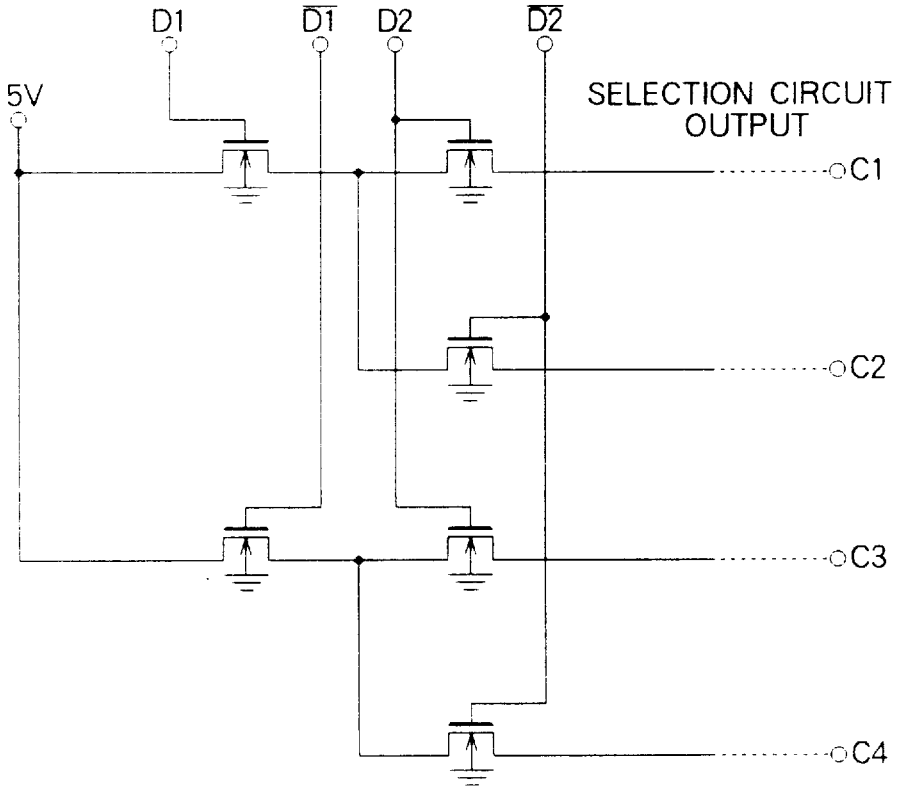
FIG. 11 is a circuit diagram showing a low voltage system selection circuit which can be employed in the driver circuit of FIG. 7.

When an output signal of the selection circuit shown in FIGS. 9 to 11 is input to the circuit block 61, the voltage of the output terminal, which is not selected, of the selection circuit is pre-charged to 0V by inputting the inverted signal of a latch enabling signal to a terminal 64. On the other hand, when the output signal from the selection circuit shown in FIG. 8 is input to the circuit block 61, since the function is included in the selection circuit, operation in the circuit block 61 is not required. Also, by inputting an output enabling signal to a terminal 65, the semiconductor switching element 82 can be controlled irrespective of the output signal of the selection circuit.

Figure 13:
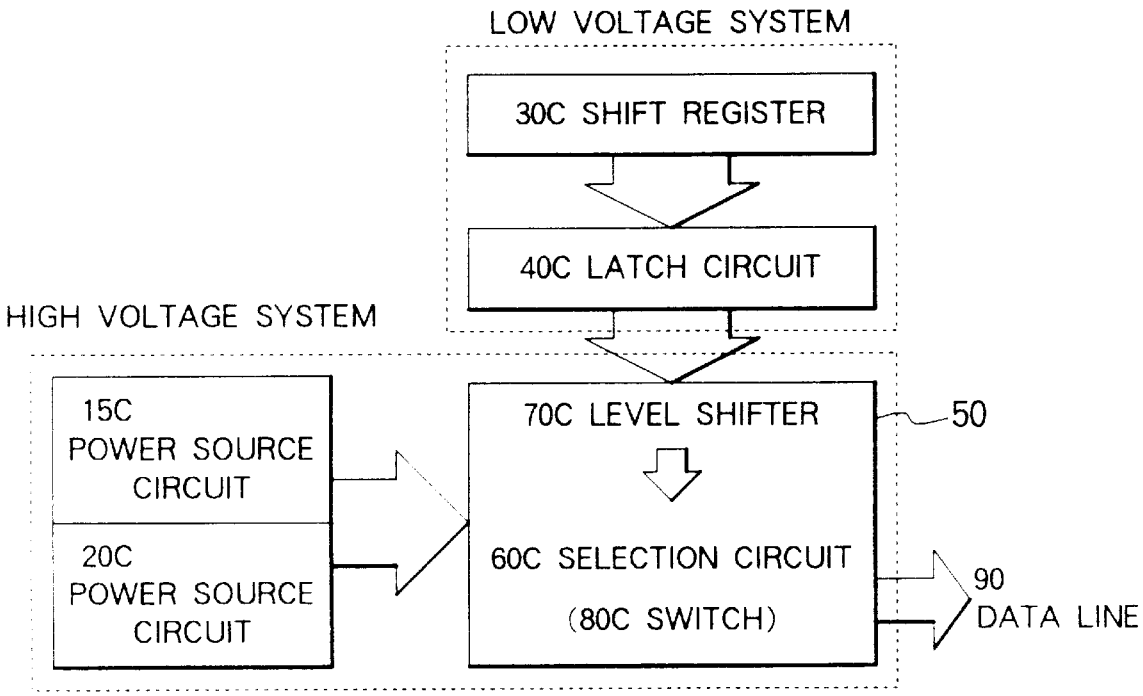
FIG. 13 is a block diagram showing a driver circuit when the selection circuit 60 in the block diagram of FIG. 4 is constructed with a high voltage system.

FIG. 13 is a block diagram showing the driver circuit when the selection circuit 60 shown in the block diagram of FIG. 4, is constructed with the high voltage system. In the shown embodiment, a power source circuits 15*c* and 20*c*, a level shifter 70*c*, a selection circuit 60*c* and a semiconductor switch 80*c* are constructed in high voltage system and a shift register 30*c* and a latch circuit 40*c* are constructed in low voltage system.

Figure 14:
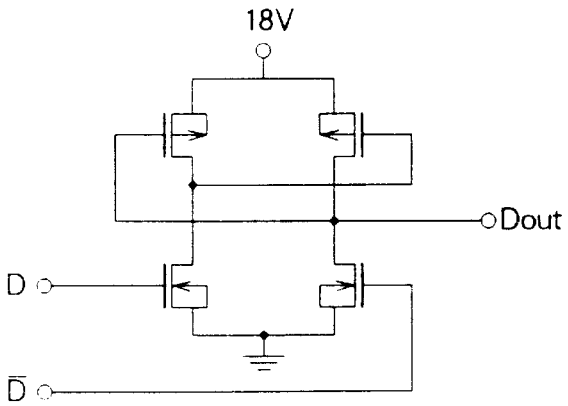
FIG. 14 is a circuit diagram showing one example of a circuit construction of a level shifter in the driver circuit shown in FIGS. 7 and 13.

FIG. 14 is a circuit diagram showing one example of the circuit construction of the level shifter in the driver circuit shown in FIGS. 7 and 13. The shown level shifter is a flip-flop type. When the output signal D and an inverted signal $\overline{D}$ from the latch circuit are input to the level shifter, conversion from the low voltage system to the high voltage system is performed by the level shifter and output as an output signal $D_{OUT}$. The level shifter of the construction set forth above, is applicable for a circuit concretely shown in FIG. 12.

Figure 15:
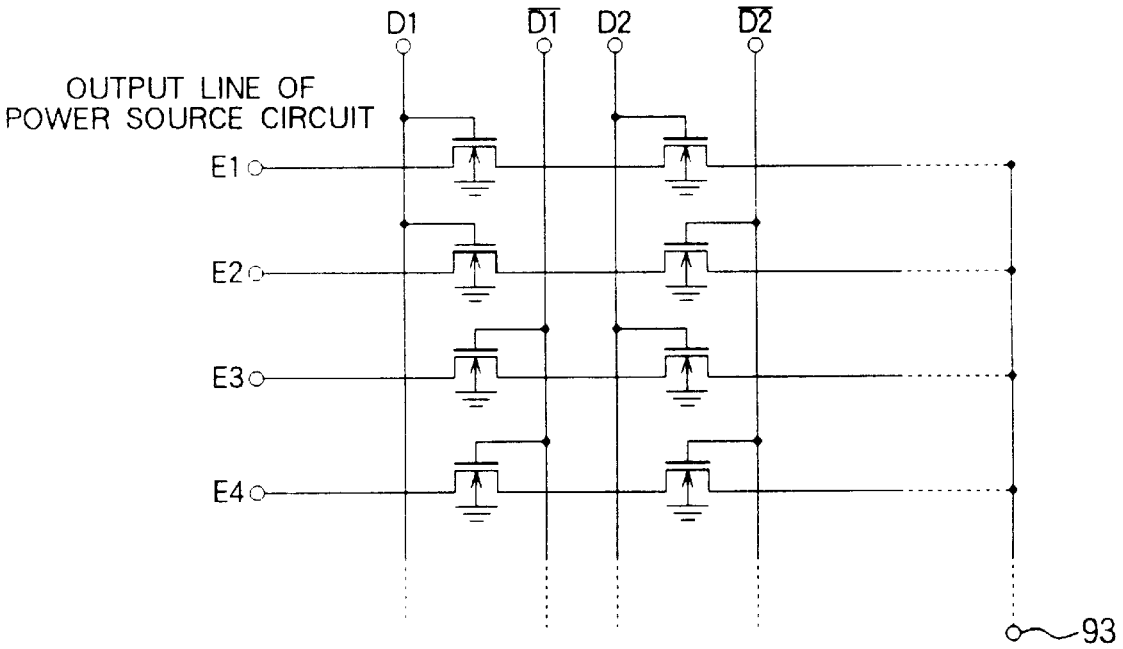
FIG. 15 is a circuit diagram showing one example of a high voltage system selection circuit which can be employed in the driver circuit shown in FIG. 13.

FIG. 15 is a circuit diagram showing one example of a high voltage system selection circuit which can be employed in the driver circuit shown in FIG. 13. At first, the output signals D1 and D2 and their inverted signals $\overline{D1}$ and $\overline{D2}$ converted into the high voltage system (e.g. 18V) by the level shifter 70*c* of FIG. 13 are input to the selection circuit. Then, output voltages E1 to E4 of the power source voltage in the selection circuit are selected. These output voltages E1 to E4 are output from the data line 93. At this time, the selection circuit also performs a function of the semiconductor switch. In FIG. 15, the circuit construction in the case of two bit input signal is shown. However, even when the bit number is increased, the circuit may be constructed in the similar manner. Also, as element of the selection circuit, N-MOS pass transistor is employed. Each element is connected to the output line of the power source voltage in series. By employing such a selection circuit, the number of element can be reduced in comparison with the low voltage type selection circuit. Therefore, the circuit construction can be further simplified.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within the scope encompassed and equivalents thereof with respect to the features set out in the appended claims.

What is claimed is:

1. A driver circuit for a liquid crystal display device comprising:

an output terminal;

a n N-MOS transistor;

a P-MOS transistor, each of said N-MOS transistor and said P-MOS transistor having a source, a drain, a gate, a substrate and a threshold voltage, respectively, a voltage $E_{N1}$ lowered for said threshold voltage from a voltage biased to said gate of said N-MOS transistor and a voltage $E_{P1}$ lowered for said threshold voltage from a voltage biased to said gate of said P-MOS transistor being output from said source of said N-MOS transistor and from said source of said P-MOS transistor as a power source, and voltages of said drains, said gates and said substrates of said N-MOS transistor and said P-MOS transistor being set so that said voltage $E_{N1}$ is greater than said voltage $E_{P1}$;

a first semiconductor switch connected between said output terminal and said N-MOS transistor; and a second semiconductor switch connected between said output terminal and said P-MOS transistor, said first and second semiconductor switches being controlled so that said voltage $E_{N1}$ of said N-MOS transistor and said voltage $E_{P1}$ of said P-MOS transistor arc alternately output through said output terminal.

2. A driver circuit as in claim 1, wherein said liquid crystal display device has a common electrode having a common electrode voltage, said voltage $E_{N1-}$ being greater than said common electrode voltage and said $E_{P1-}$ voltage being less than said common electrode voltage.

3. A driver circuit for a liquid crystal display device comprising:

an output terminal;

n in number of N-MOS transistors;

m in number of P-MOS transistors, each of said N-MOS transistors and said P-MOS transistors having a source, a drain, a gate, a substrate and a threshold voltage, respectively, n in number of voltages $E_N$ lowered for said threshold voltages from voltages biased to said gates of said N-MOS transistors and m in number of voltages $E_P$ lowered for said threshold voltages from voltages biased to said gates of said P-MOS transistors being output from said sources of said N-MOS transistors and from said sources of said P-MOS transistors as power sources, and voltages of said drains, said gates and said substrates of said N-MOS transistors and said P-MOS transistors being set so that said voltages $E_N$ are greater than said voltages $E_P$;

n in number of first semiconductor switches connected between said output terminal and n in number of said N-MOS transistors, respectively; and m in number of second semiconductor switches connected between said output terminal and m in number of said P-MOS transistors$_1$ respectively, said first and second semiconductor switches being controlled so that said voltages $E_N$ of said N-MOS transistors and said voltages $E_P$ of said P-MOS transistors are alternately output through said output terminal.

4. A driver circuit as in claim 3, wherein said liquid crystal display device has a common electrode having a common electrode voltage, said voltages $E_{N-}$ being greater than said common electrode voltage and said voltages $E_{P-}$ being less than said common electrode voltage.

* * * * *